United States Patent [19]

Lucas et al.

[11] 4,262,845

[45] Apr. 21, 1981

[54] CONCRETE SLAB STRUCTURE FOR RAILWAY TRACK

[75] Inventors: John C. Lucas, Allestree; William K. Aitken, Weston-on-Trent, both of England

[73] Assignee: British Railways Board, Great Britain

[21] Appl. No.: 22,519

[22] Filed: Mar. 21, 1979

[30] Foreign Application Priority Data

Mar. 30, 1978 [GB] United Kingdom ..... 12391/78

[51] Int. Cl.[3] ..... E01B 1/00

[52] U.S. Cl. ..... 238/7; 238/2; 238/284

[58] Field of Search ..... 238/7, 2, 259, 284, 238/382, 1

[56] References Cited

U.S. PATENT DOCUMENTS

| | | | |
|---|---|---|---|
| 708,347 | 9/1902 | Haas | 238/7 |
| 1,109,862 | 9/1914 | Myers | 238/284 |
| 1,263,915 | 4/1918 | Matheny | 238/284 |
| 3,104,059 | 9/1963 | Gordon | 238/284 |
| 3,790,078 | 2/1974 | Egerbork et al. | 238/2 |

*Primary Examiner*—Richard A. Bertsch

*Attorney, Agent, or Firm*—Strimbeck, Davis & Soloway

[57] ABSTRACT

A concrete slab structure for supporting railway track is itself resiliently supported on a base structure by a spring system comprising tubes secured against longitudinal movement in holes extending through the slab from its top surface to its bottom surface, springs each arranged in a respective one of the tubes and an adjustable spring abutment at the upper end of each of the tubes for pre-loading the springs against the base structure.

10 Claims, 5 Drawing Figures

CONCRETE SLAB STRUCTURE FOR RAILWAY TRACK

This invention relates to concrete slab structures for railway track. There are considerable advantages in fixing rails directly to concrete slabs for railway tracks in tunnels instead of the use of transverse sleepers or ties and ballast. These advantages are primarily that future track maintenance is significantly reduced and generally the track construction depth is reduced allowing either a reduced tunnel section or increased overhead clearance.

However, in urban areas there can be problems associated with the transmission of vibration from the tracks through the ground to adjoining buildings. In order to reduce the level of train generated vibrations transferred into the ground, it is necessary to mount the track on systems having as low a natural frequency as possible since low frequency vibrations travel through soils with little attenuation and can cause the low frequency rumble which can be felt and heard in buildings. This can be achieved by the careful selection of the resilient system between the rails and the concrete slab, but in very vibration sensitive areas, e.g. under concert halls, a more elaborate system is required.

Mathematical analysis and experimental work has shown that the provision of resilient support between the track slab and the base structure, e.g. a tunnel invert, will provide the best solution. However, the selection of the correct resilience and damping is very important to give a balance between good vibration isolation and satisfactory train operating conditions.

The attainment of a track system with a low natural frequency is accomplished by a combination of high track mass and a low track support stiffness and there are practical limits to both these parameters. If the track mass is made high, it means that the size and construction will be expensive because of the need to increase tunnel size to accommodate the slab and the additional quantities of concrete and reinforcement required for the track slab. Very low track support stiffnesses can cause problems with vehicle ride. The slab mass and support stiffness must therefore both be a compromise, bearing in mind that the structural design of the track slab is dependent on the resilient support stiffness.

Previous designs of resiliently mounted tracks have generally used elastomeric systems underneath the slabs, but once these are installed it is very expensive to either replace or modity the track resilience.

The object of the present invention is to provide a resiliently mounted concrete slab structure for railway track and whose resilience can be adjusted from the top surface of the slab.

According to the invention a concrete slab structure comprises (a) a concrete slab, (b) a series of tubes secured against longitudinal movement in holes in in the slab extending through the slab from its top surface to its bottom surface, (c) springs each arranged in a respective one of said tubes and (d) adjustable means locating in the upper ends of each of said tubes for pre-loading said springs against a base supporting structure for the slab whereby the slab is lifted off said base structure and resiliently supported by said springs.

In the case of slabs cast in situ, the preferred method of fitting the tubes is to line the smooth concrete invert with a strong water-proof membrane which prevents new concrete bonding onto old. Onto this membrane a series of tubes is placed and located with respect to the reinforcement. The tubes are positioned with their axes vertical and as close as possible to the line of the rails. The top edge of the tube should be flush with the proposed top of the slab.

The tops of the tubes are either sealed with temporary closures or filled with expanded polystyrene and the track slab is cast or slip form paved over the base, incorporating the tubes into the concrete. In the case of precast slabs, the tubes would be cast in at the casting yard. For existing slabs where the vibration isolation is inadequate, holes may be core drilled through the track slab and the metal tubes glued into these holes as sleeves.

To complete the installation ground plates may be placed under the tubes onto the base structure and then the spring system with damping is placed on the ground plate.

The weight of the slab is transferred to the springs by either a screw cap which is screwed into the top of the tube or by similar techniques and the slab is lifted and hence supported by the spring system. Care will need to be exercised to ensure that each spring carries the correct proportion of the slab weight.

Two possible spring configurations may be used:

1. Disc springs may be used in differing combinations to provide the desired stiffness and damping. With this system damping and stiffness can be readily changed by changes in numbers and types of discs used.

2. Steel helical springs encased in a silicone rubber tubes or similar material may be used to give the required stiffness and damping characteristic. Alternatively an elastomer alone can be used to give the requisite stiffness and damping.

The invention will now be further described by way of example with reference to the accompanying drawings, in which.

Figure 1:
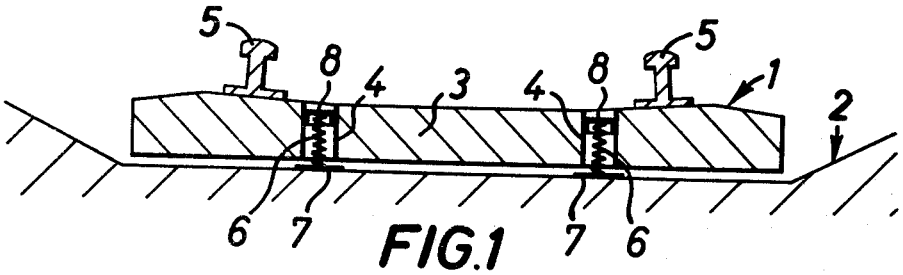
FIG. 1 is a cross-section through railway track embodying one form of concrete slab structure in accordance with the invention.
Figure 2:
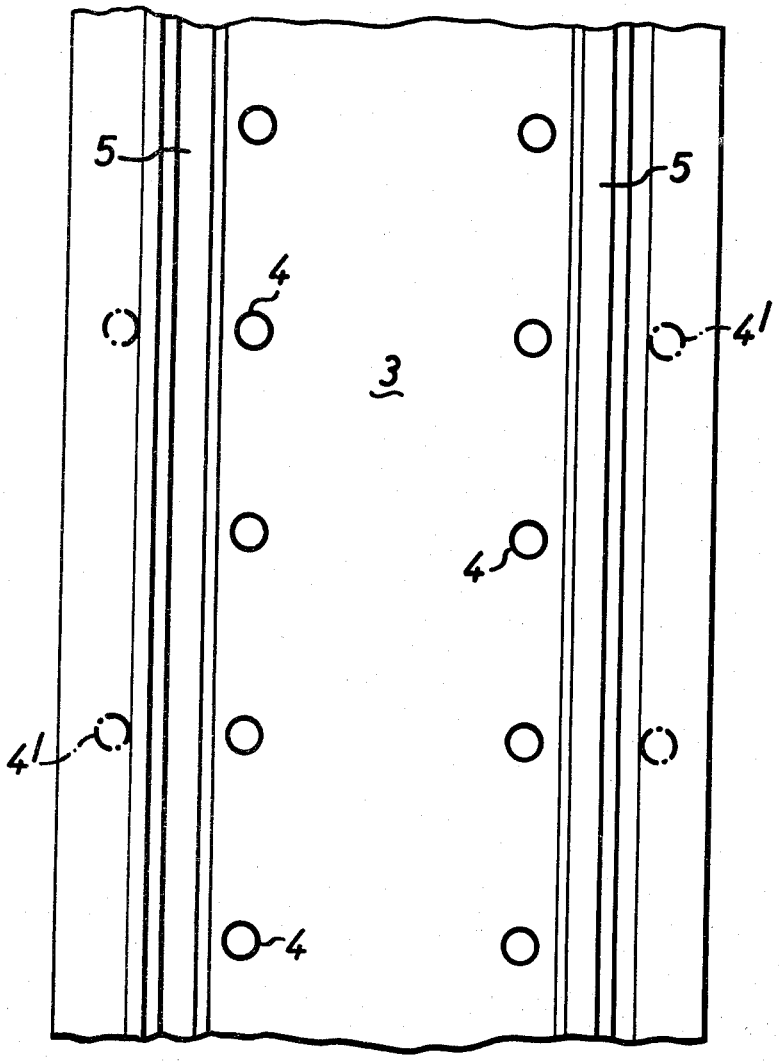
FIG. 2 is a plan view of FIG. 1.

Referring to FIGS. 1 and 2 the concrete slab structure 1 is shown supported on a base structure in the form of tunnel invert 2. The concrete slab structure comprises a reinforced or prestressed concrete slab 3 in which metal tubes 4 are fitted. The tubes 4 may be cast in situ in the slab 3 or bonded in position. They extend vertically completely through the slab and their lower and upper ends are substantially flush with the top and bottom surfaces of the slab 3. The tubes 4 run as close to the lines of the rails 5 as best seen in FIG. 2. Alternative position for the tubes is shown at $4^1$ in FIG. 2.

Located within each of the tubes 4 is a spring 6, in this example a coil spring, which at its lower end rests on bearer plate 7 and at its upper end abuts a cap 8 screwed into the tube 4 to pre-load the spring. The bearer plates 7 are optional.

Thus during installation the springs 6 are inserted into the tubes 4 from the top and the caps 8 are then screwed into the tubes to pre-load the springs 6 and cause them to life the slab 3 off the invert 2. It will be appreciated that the spring system can be subsequently adjusted from the top of the slab 3 by adjustment of the caps 8.

Figure 3:
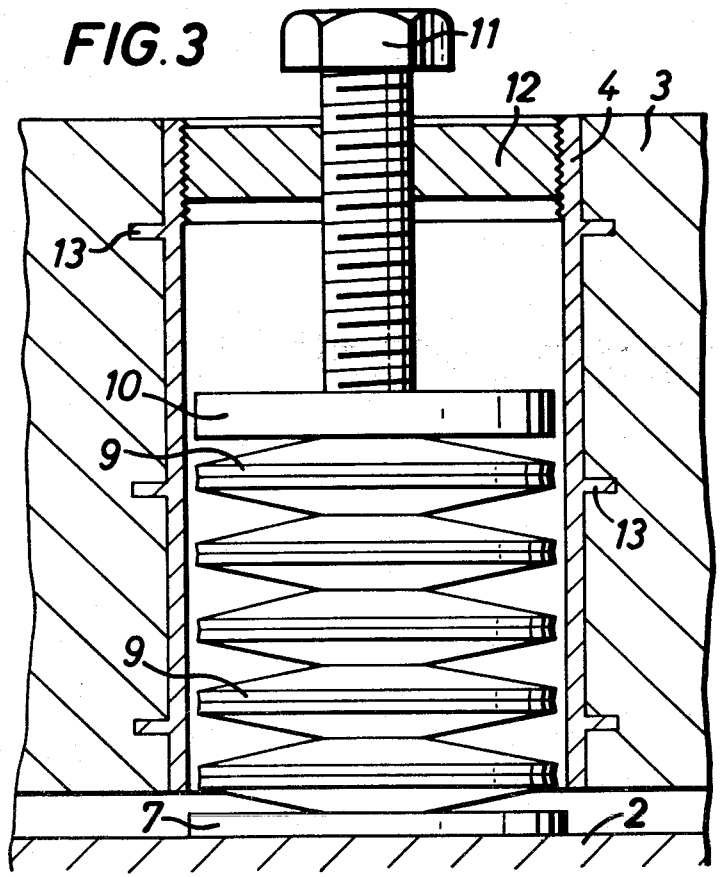

Referring to FIG. 3, this shows as the spring associated with each tube the use of an assembly of a vertical series of disc springs 9. At its lower end the series of disc springs 9 rests on the bearer plate 7 and at its upper end is engaged by a bearer plate 10 to which pressure can be applied by bolt 11. The bolt 11 threadedly engages in plate 12 screwed into the top of the tube 4. In the FIG. 3 structure the tube 4 is cast into the slab 3, and is provided with flanges 13 to locate it more securely in the slab 3.

Figure 4:
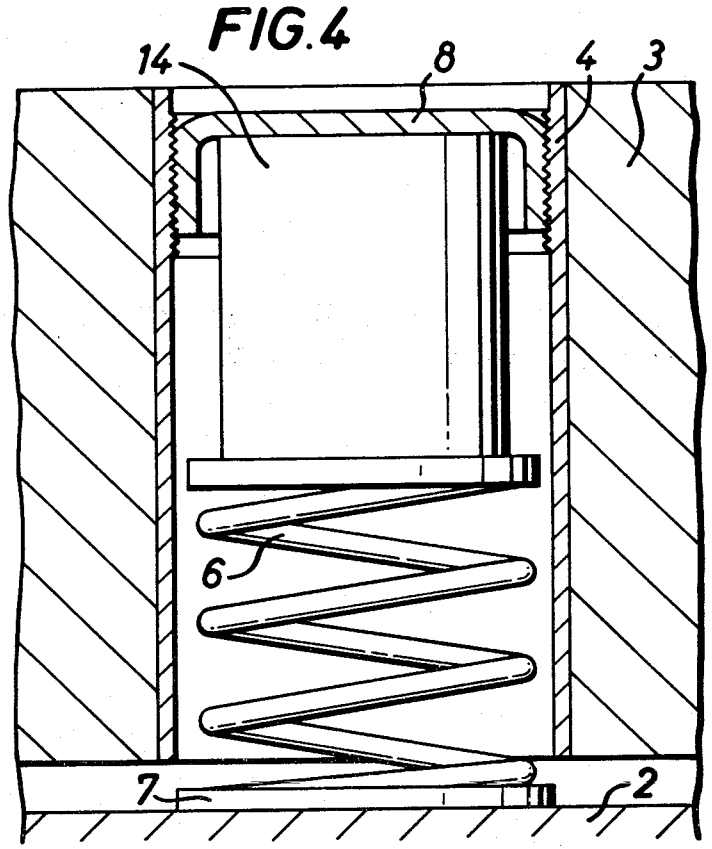
FIGS. 3, 4 and 5 illustrate alternative arrangements for providing the resilient mounting of the concrete slab structures.

Referring to FIG. 4, this shows the same spring system as FIG. 1 except that a spacer 14 is interposed between the top of the coil spring 6 and the cap 8.

Figure 5:
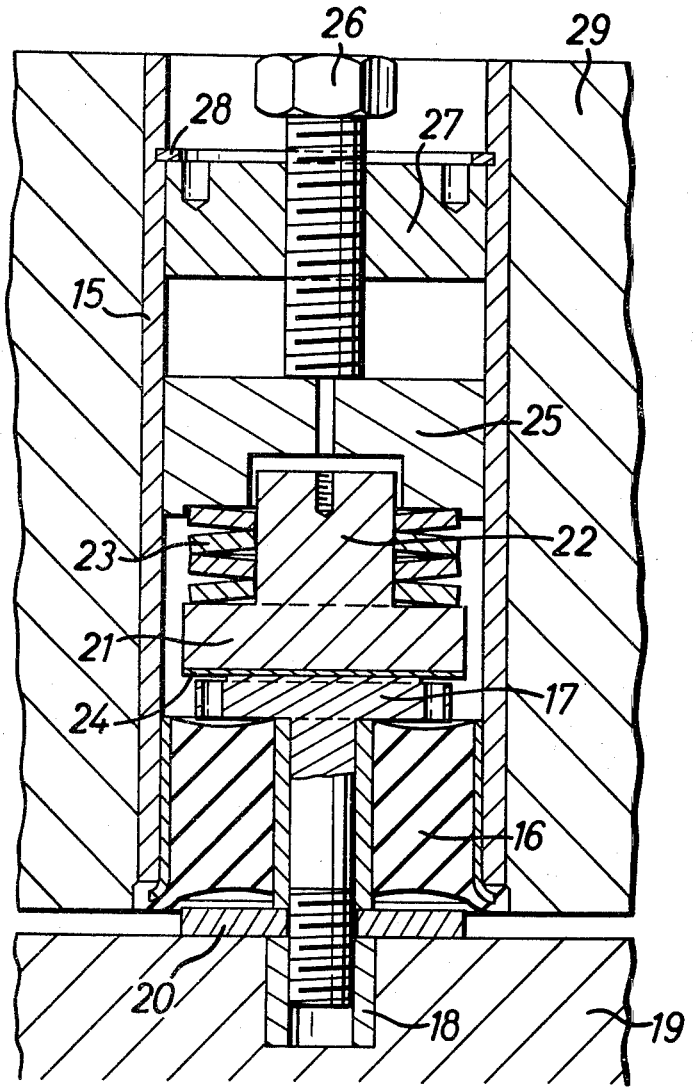

Referring to FIG. 5, this shows a further form of resilient system comprising a steel tube 15 at the lower end of which is fitted a resilient bush 16 for example of rubber or other elastomeric material. A bolt 17 extends through the bush and is screwed into a socket 18 set into a base structure 19 e.g. a tunnel invert or base concrete. As will become apparent the bolt 17 constitutes a post for supporting the spring system on the base structure 19. The bolt 17 is screwed tightly against a steel plate 20 set on to the surface of the base structure 19. Sitting on the head of the bolt 20 is a machined plate 21 with a spigot 22. Located on the spigot 22 is an assembly of cupped disc springs 23. Between the plate 21 and bolt 17 a layer 24 of low friction material is interposed. The number and size of the springs 23 can be varied to change the stiffness and the damping characteristics of the resilient system.

The reaction of the springs is taken by a plate 25 which in turn reacts against a bolt 26. The bolt 26 is screwed into top plate 27 which is held against vertical movement by circlip 28 engaging in a groove in the internal surface of the tube 15. The tube 15 can either be glued into a formed hole in the concrete slab 29 or cast in when the slab is manufactured.

In installing the spring systems, the tubes 15 are set normal to the base structure 19 and are usually placed in pairs as near to each rail as possible. Preferably they should be set alternately on either side of each rail at approximately 1 m centres.

The screw sockets 18 for anchoring the resilient units are either cast or glued into the structure 19 and are preferably of stainless steel.

The base structure 19 is then covered with one or two layers of heavy duty polythene sheeting, ensuring that all joints are either taped or welded to prevent leakage of concrete onto the base structure. The plate 20 is positioned over each socket and a hole punched through the polythene using the hole in the plate as a template to give access to the screwed hole in the socket.

The interior components of the system are removed from the tube 15 leaving only the resilient bush 16 and the bolt 17 passing through this bush. The tube 15 is set on the base and the bolt 17 screwed into the socket 18 until a predetermined torque is reached. This seals the polythene against the base concrete and also seals the lower face of the resilient bush 16, where it projects beyond the steel tube against the polythene. This latter sealing is to prevent cement grout from leaking under the unit when the slab is cast.

The remaining components of the system are then inserted and the top sealed with a watertight cap. Reinforcement for the slab 20 is then positioned and the slab 29 cast. Slabs should preferably be continuous over lengths up to 50 m and should then be joined by contraction joints which can transmit vertical shear.

When the concrete has cured the slabs 29 are lifted onto the spring system by screwing down the bolt 26 a predetermined amount from the "finger tight" position. It will be necessary to do this lifting by screwing each bolt a limited amount and working sequentially round them. The amount of lift should be sufficient to stop the slab bottoming under the heaviest expected vehicle. The units are then sealed from the top.

The resilient bush 16 at the base of each tube 15 has a number of functions.

Primarily it is intended to provide lateral and longitudinal restraint to the suspended slab without providing a vibrational path around the spring system and to provide this restraint without sliding contact. It also allows for a small amount of misalignment between the tube axis and the axis normal to the concrete support base. A further feature is that it provides a watertight seal to the lower portion of the tube 15.

The bush, therefore, has to accommodate the longitudinal braking and traction forces without being overstressed and to distribute the forces due to shrinkage and thermal effects of the suported slab. It also allows full vertical movement of the slab but with negligible change of force compared with the spring force and negligible damping.

We claim:

1. A concrete slab structure for railway track comprising (a) a concrete slab, (b) a series of tubes secured against longitudinal movement in holes in the slab extending through the slab from its top surface to its bottom surface, (c) springs each arranged in a respective one of said tubes and (d) adjustable means locating in the upper ends of each said tube for pre-loading said springs against a supporting base structure for the slab whereby the slab is lifted off said base structure and resiliently supported by said springs.

2. A structure according to claim 1, wherein said tubes extend in two lines each adjacent the intended line of a respective rail of the railway track.

3. A structure according to claims 1, wherein said adjustable means comprises an abutment for the upper end of each said spring and which can be adjusted longitudinally of the tube by a screwing action to adjust the pre-loading of the associated spring.

4. A structure according to claim 3 wherein said adjustable means comprises a cap member which threadedly engages the inside of the associated tube.

5. A structure according to claim 1, wherein the lower end of each said tube is fitted with a rubber member which seals off the lower end of said tube.

6. A concrete slab structure for railway track comprising (a) a concrete slab, (b) a series of tubes secured against longitudinal movement in holes in the slab extending through the slab from its top surface to its bottom surface, (c) a spring in each of said tubes and (d) a cap threadedly engaged with and in the top inside of each of said tubes, and (e) a spacer between each cap and the top end of the associated spring, said cap being adjustable longitudinally of the tube by a screwing action to adjust the pre-loading of said associated spring, the lower end of each of said springs acting against a supporting base structure for the slab whereby the slab is lifted off said base structure and resiliently supported by said springs.

7. A concrete slab structure for railway track comprising (a) a concrete slab, (b) a series of tubes secured against longitudinal movement in holes in the slab extending through the slab from its top surface to its bottom surface, (c) springs each arranged in a respective one of said tubes and (d) adjustable means adapted to the pre-load said springs and comprising a bolt which abuts the upper end of the associated spring through a bearer plate and which threadedly engages an end plate secured against an upward vertical movement in the upper end of the associated tube, the lower end of each of said springs acting against a supporting base structure for the slab whereby the slab is lifted off said base structure and resiliently supported by said springs.

8. A concrete slab structure for railway track comprising (a) a concrete slab, (b) a series of tubes secured against longitudinal movement in holes in the slab extending through the slab from its top surface to its bottom surface, (c) springs each arranged in a respective one of said tubes, (d) adjustable means located in the upper ends of each said tube for pre-loading said springs against a supporting base structure for the slab whereby the slab is lifted off said base structure and resiliently supported by said springs, and (e) support means at the lower end of each of said springs supporting the associated spring on said base structure comprising a plate member which rests on the head of a bolt screwed into a threaded insert in said base structure.

9. A structure according to claim 8, wherein said plate member has an upstanding spigot around which the spring locates.

10. A concrete slab structure for railway track comprising (a) a concrete slab, (b) a series of tubes secured against longitudinal movement in holes in the slab extending through the slab from its top surface to its bottom surface, (c) a spring in each of said tubes and supported on the base structure through a post, (d) an elastomeric bush fitted in the lower end of the associated tube and through which said post extends and providing a resilient restraint to horizontal movement of said slab, and (e) adjustable means locating in the upper ends of each said tube for preloading said springs against a supporting base structure for the slab whereby the slab is lifted off said base structure and resiliently supported by said springs.

* * * * *

UNITED STATES PATENT AND TRADEMARK OFFICE

CERTIFICATE OF CORRECTION

PATENT NO. : 4,262,845

DATED : April 21, 1981

INVENTOR(S) : John C. Lucas and William K. Aitken

It is certified that error appears in the above-identified patent and that said Letters Patent are hereby corrected as shown below:

Column 5, line 3, the word "adjust" should be inserted before the word "the";

Also, the word "pre-load" should read "pre-loading of".

Signed and Sealed this

*Fourth* Day of *August 1981*

[SEAL]

*Attest:*

GERALD J. MOSSINGHOFF

*Attesting Officer*

*Commissioner of Patents and Trademarks*